US012446697B2

(12) United States Patent
Cai et al.

(10) Patent No.: US 12,446,697 B2
(45) Date of Patent: Oct. 21, 2025

(54) LOWER-BACK SUPPORTING APPARATUS, BACKREST SUPPORTING FRAME AND SEATING UNIT

(71) Applicant: Remacro Technology Co., Ltd., Jiangsu (CN)

(72) Inventors: Saijun Cai, Jiangsu (CN); Xiaohong Li, Jiangsu (CN); Gang Song, Jiangsu (CN)

(73) Assignee: Remacro Technology Co., Ltd., Suzhou (CN)

( * ) Notice: Subject to any disclaimer, the term of this patent is extended or adjusted under 35 U.S.C. 154(b) by 258 days.

(21) Appl. No.: 18/196,452

(22) Filed: May 12, 2023

(65) Prior Publication Data

US 2024/0130533 A1 Apr. 25, 2024
US 2024/0225293 A9 Jul. 11, 2024

(30) Foreign Application Priority Data

Oct. 21, 2022 (CN) ..... 202222789877.6

(51) Int. Cl.
*A47C 7/46* (2006.01)

(52) U.S. Cl.
CPC ..... *A47C 7/462* (2013.01)

(58) Field of Classification Search
CPC ..... A47C 7/462
See application file for complete search history.

(56) References Cited

U.S. PATENT DOCUMENTS

| | | | | |
|---|---|---|---|---|
| 5,553,919 | A * | 9/1996 | Dennis | A47C 7/462 297/284.8 |
| 6,695,402 | B2 * | 2/2004 | Sloan, Jr. | B60N 2/66 297/284.4 |
| 8,474,909 | B2 * | 7/2013 | LaPointe | A47C 7/462 297/284.4 |
| 8,807,651 | B2 * | 8/2014 | LaPointe | A47C 7/462 297/284.4 |
| 9,826,841 | B2 * | 11/2017 | Donovan | A47C 7/462 |
| 9,949,567 | B2 * | 4/2018 | Sigmon | A47C 1/036 |
| 10,123,625 | B2 * | 11/2018 | Sigmon | A47C 7/462 |
| 10,368,646 | B2 * | 8/2019 | Donovan | B60N 2/66 |

(Continued)

FOREIGN PATENT DOCUMENTS

CN 215533019 U 1/2022

*Primary Examiner* — Rodney B White

(57) ABSTRACT

Provided are a lower-back supporting apparatus, a backrest supporting frame, and a seating unit. The lower-back supporting apparatus includes a lower-back supporting plate; a lower mounting plate; two supporting structures, provided between the lower-back supporting plate and the lower mounting plate, hinged to the lower-back supporting plate and the lower mounting plate, respectively; and an extendable and retractable part, including an extendable and retractable end hinged to the lower-back supporting plate or the supporting structure, so as to drive the lower-back supporting plate away or close to the lower mounting plate. The lower-back supporting plate may be lifted and lowered by cooperating the extendable and retractable part with the supporting structure; the volume of lower-back supporting apparatus may be effectively reduced by adopting the extendable and retractable part; the whole of the extendable and retractable part is easy to maintain and replace.

13 Claims, 6 Drawing Sheets

(56) References Cited

U.S. PATENT DOCUMENTS

| | | | | |
|---|---|---|---|---|
| 10,376,063 | B2 * | 8/2019 | Donovan | A47C 7/38 |
| 10,383,447 | B2 * | 8/2019 | Sigmon | A47C 7/38 |
| 10,653,245 | B2 * | 5/2020 | Zhang | A47C 7/38 |
| 10,660,441 | B2 * | 5/2020 | Ma | A47C 1/034 |
| 10,736,423 | B2 * | 8/2020 | Brown | A47C 1/0242 |
| 10,736,426 | B2 * | 8/2020 | Fei | A47C 7/38 |
| 10,952,535 | B2 * | 3/2021 | Bucholz | A47C 7/462 |
| 11,246,420 | B1 * | 2/2022 | Marquez | A47C 7/462 |
| 11,284,724 | B2 * | 3/2022 | Bucholz | A47C 7/462 |
| 11,324,324 | B2 * | 5/2022 | Bucholz | A47C 7/462 |
| 11,478,083 | B1 * | 10/2022 | Li | A47C 17/04 |
| 11,672,348 | B2 * | 6/2023 | Bucholz | A47C 7/462 297/216.12 |
| 11,723,472 | B1 * | 8/2023 | Marquez | A47C 7/462 297/284.4 |
| 11,986,101 | B2 * | 5/2024 | Koltzenburg | A47C 7/462 |
| 2024/0423369 | A1 * | 12/2024 | Loccioni | A47C 1/0342 |

* cited by examiner

LOWER-BACK SUPPORTING APPARATUS, BACKREST SUPPORTING FRAME AND SEATING UNIT

CROSS REFERENCE TO RELATED APPLICATIONS

The present application claims the benefit of Chinese Patent Application No. 202222789877.6 filed on Oct. 21, 2022, the contents of which are incorporated herein by reference in their entirety.

FIELD OF THE INVENTION

The present invention relates to the field of functional sofa, in particular to a lower-back supporting apparatus, a backrest supporting frame and a seating unit.

BACKGROUND OF THE INVENTION

Functional sofas or chairs enable certain parts of the user's body to relax better by adjusting the structure. A main structural part of a functional sofa or chair is the lower-back supporting apparatus mounted on the backrest, which provides support to the user's back by adjusting the distance between the surface of the backrest and the user's back in order to ease the user's back fatigue.

The lower-back supporting apparatus in the prior art is, with complex structure, mostly a scissor lift structure cooperated with a driving screw. Inconvenient maintenance of the driving screw and the relatively restrictive mounting position may lead to a great limitation in the specific application (such as assembled on sofas or chairs) of the lower-back supporting apparatus, thereby leading to a limitation in the applicable circumstances and a poor versatility of the lower-back supporting apparatus.

SUMMARY OF INVENTION

In order to address the shortcomings of the prior art, the first purpose of the present invention is to provide a lower-back supporting apparatus whose structure is simple; the mounting of the extendable and retractable part may be adaptively adjusted based on the practical and applicable scene, which facilitates maintenance.

The second purpose of the present invention is to provide a backrest supporting frame, which may provide an adjustable support for the user's back and is suitable for a broad range of people.

The third purpose of the present invention is to provide a seating unit, which may ease the fatigue of the user's back and facilitate maintenance.

Embodiments of the present invention are implemented by the technical solution as follows:

A lower-back supporting apparatus comprises a lower-back supporting plate; a lower mounting plate; two supporting structures, provided between the lower-back supporting plate and the lower mounting plate, hinged to the lower-back supporting plate and the lower mounting plate, respectively; and an extendable and retractable part, comprising an extendable and retractable end hinged to the lower-back supporting plate or the supporting structure, so as to drive the lower-back supporting plate away or close to the lower mounting plate.

According to a preferred embodiment, each of the supporting structures comprises a first link and a second link hinged to each other, wherein the first link is hinged to the lower-back supporting plate, and the second link is hinged to the lower mounting plate; or the second link is hinged to the lower-back supporting plate, and the first link is hinged to the lower mounting plate; and two restricting protrusions are provided on the first link, wherein the second link and a hinge point between the first link and the second link are located between the two restricting protrusions.

According to a preferred embodiment, each of the supporting structures comprises a first link and a second link hinged to each other, wherein the first link of one supporting structure is hinged to the lower-back supporting plate and the second link thereof is hinged to the lower mounting plate; the second link of another support structure is hinged to the lower-back supporting plate, and the first link thereof is hinged to the lower mounting plate; and two restricting protrusions are provided on the first link, wherein the second link and a hinge point between the first link and the second link are located between the two restricting protrusions.

According to a preferred embodiment, the extendable and retractable part is provided between any two of the lower-back supporting plate, the lower mounting plate, the first link, and the second link, so as to drive the lower-back supporting plate away or close to the lower mounting plate; or the extendable and retractable part is provided between two first links or two second links, so as to drive the lower-back supporting plate away or close to the lower mounting plate.

According to a preferred embodiment, the first link comprises a body part and a restricting part connected to each other; the hinge point between the first link and the second link is defined as the first hinge point, wherein the restricting protrusion and the first hinge point are both located on the restricting part; a convex arch is provided on an outer side of the first link, and a concave arch is provided on an opposite side of the convex arch, wherein the convex arch and the concave arch are both located on the restricting part; and at least one of the restricting protrusions is provided on the convex arch.

According to a preferred embodiment, ends of the two first links hinged to the lower-back supporting plate near the lower-back supporting plate are frictionally abutted, and ends of the two second links hinged to the lower mounting plate near the lower mounting plate are frictionally abutted; or ends of the two second links hinged to the lower-back supporting plate near the lower-back supporting plate are frictionally abutted, and ends of the two first links hinged to the lower mounting plate near the lower mounting plate are frictionally abutted.

According to a preferred embodiment, respective ends of the first link and the second link hinged to the lower-back supporting plate near the lower-back supporting plate are frictionally abutted; and respective ends of the first link and the second link hinged to the lower mounting plate near the lower mounting plate are frictionally abutted.

According to a preferred embodiment, the extendable and retractable part is any one of a cylinder, a hydraulic cylinder, or an electric pusher.

According to a preferred embodiment, a distance between the lower-back supporting plate and the lower mounting plate is defined as H; the H is between 55 and 250 millimeters when the lower-back supporting plate is away or close to the lower mounting plate.

According to a preferred embodiment, an extending direction of the lower-back supporting plate is defined as a width direction; the lower-back supporting apparatus along the width direction is between 180 and 440 millimeters.

A backrest supporting frame comprises a fixing frame and the lower-back supporting apparatus mentioned above, wherein the fixing frame comprises two lateral plates connected by a crossbeam; the lower-back supporting apparatus is provided between two lateral plates and fixedly mounted on the crossbeam by the lower mounting plate.

According to a preferred embodiment, the backrest supporting frame further comprises a headrest structure provided between two lateral plates and located on an upper side of the lower-back supporting apparatus.

A seating unit comprises the backrest supporting frame mentioned above.

The technical solutions of embodiments of the present invention provide at least the advantages and beneficial effects as follows:

The present invention has a simple structure. Lifting and lowering the lower-back supporting plate may be realized by cooperating the extendable and retractable part with the supporting structure; the mounting layout of the extendable and retractable part may be adaptively adjusted based on the appearance or contour of the product during practical assembly due to the flexibility of position and sufficiency of space while mounting the extendable and retractable part; the volume of lower-back supporting apparatus may be effectively reduced by adopting the extendable and retractable part; the whole of the extendable and retractable part is easy to maintain and replace.

BRIEF DESCRIPTION OF THE DRAWINGS

In order to illustrate more clearly the technical solutions of the embodiments of the present invention, hereinafter provided is a brief description of the attached drawings required in the embodiments. It is to be understood that the following attached drawings only illustrate certain embodiments of the invention and thus should not be construed as a limitation of scope. Other relevant drawings may be obtained on the basis of these attached drawings without any inventive effort by those of ordinary skill in the art.

Figure 1:
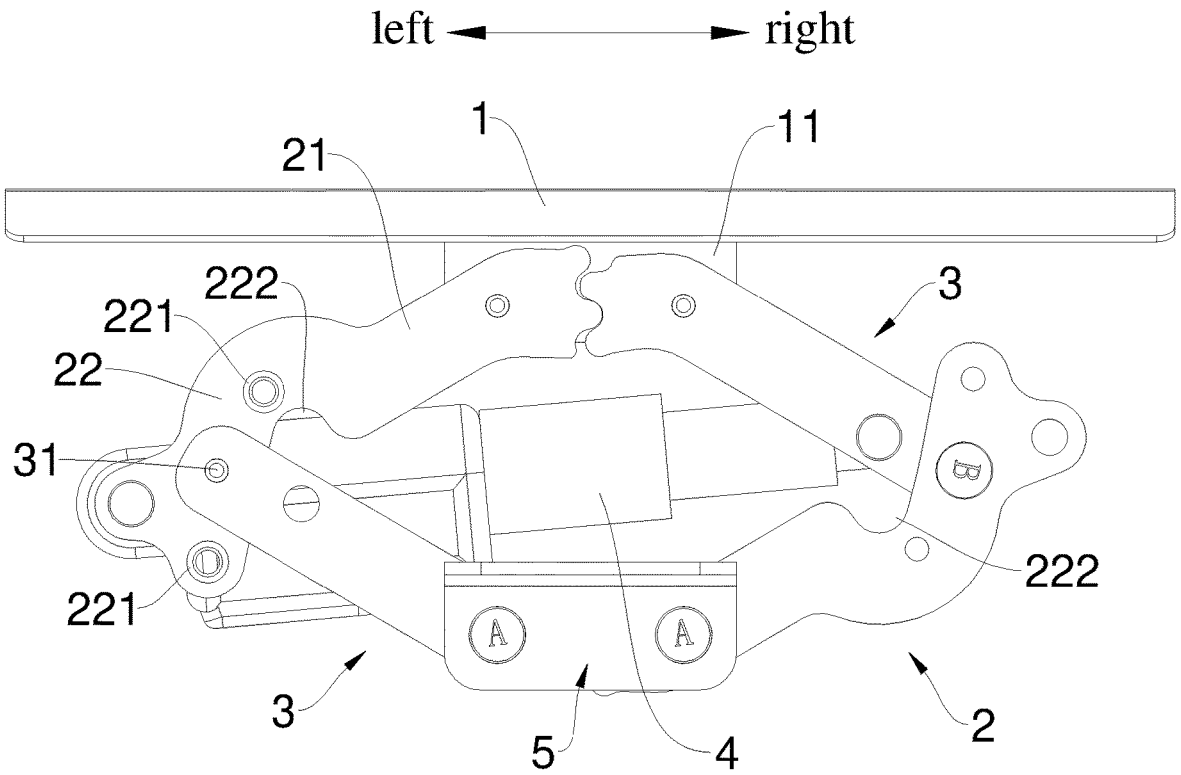
FIG. 1 is a front view of a structural diagram of a lower-back supporting apparatus provided in the present invention in the intermediate state.

1: lower-back supporting plate; 11: upper mounting plate; 2: first link; 21: body part; 211: third hinged hole; 212: first tooth; 22: restricting part; 221: restricting protrusion; 222: concave arch; 223: first hinged hole; 224: convex arch; 225: second hinged hole; 23: first frictional plane; 3: second link; 31: first hinge point; 32: fourth hinged hole; 33: fifth hinged hole; 34: second tooth; 35: sixth hinged hole; 36: second frictional plane; 4: extendable and retractable part; 5: lower mounting plate; 51: first fixing part; 52: second fixing part; 6: fixing frame; 61: lateral plate; 62: second crossbeam; 63: first crossbeam; 64: third crossbeam; 7: headrest structure; 71: fixing part; 72: transverse mounting link.

DETAILED DESCRIPTION OF THE PREFERRED EMBODIMENTS

For better understanding and implementation, the technical solutions in embodiments of the present invention will be clearly and completely described below in conjunction with the attached drawings in embodiments of the present invention.

In the description of the present invention, it is to be noted that the terms "up", "down", "front", "back", "left", "right", "vertical", "horizontal", "top", "bottom", "inside", "outside" and other orientation or lateral position relationships are based on the orientation or lateral position relationships shown in the attached drawings. It is only intended to facilitate description and simplify operation, but not to indicate or imply that the referred device or element has a specific orientation, or is constructed and operated in a specific orientation. Therefore, they should not be construed as a limitation of the present invention.

Unless otherwise defined, all terms including technical and scientific terms used herein have the same meaning as commonly understood by those skilled in the art to which the present invention belongs. The terms used herein in the specification of the present invention are used only to describe specific embodiments and are not intended as a limitation of the invention.

First Embodiment

Please refer to FIG. 1 to FIG. 7; a lower-back supporting apparatus, applicable to a backrest of a seating unit, provides support for the user's lower back. In the present embodiment, the lower-back supporting apparatus comprises a lower-back supporting plate 1; a lower mounting plate 5; two supporting structures, provided between the lower-back supporting plate 1 and the lower mounting plate 5, hinged to the lower-back supporting plate 1 and the lower mounting plate 5, respectively; and an extendable and retractable part 4, comprising an extendable and retractable end hinged to the lower-back supporting plate 1 or the supporting structure, so as to drive the lower-back supporting plate 1 away or close to the lower mounting plate 5. In addition, the lower-back supporting apparatus further comprises an upper mounting plate 11 fixedly connected to the lower-back supporting plate 1, wherein the supporting structure is hinged to the lower-back supporting plate 1 through the upper mounting plate 11. In use, by controlling the extension and the retraction of the extendable and retractable part, the extendable and retractable end on the extendable and retractable part 4 drives the lower-back supporting plate 1 or the supporting structure to move, so as to drive the lower-back supporting plate 1 away or close to the lower mounting plate 5, thereby realizing the adjustment of the distance between the lower-back supporting plate 1 and the lower mounting plate 5. In such a setup, the mounting layout of the extendable and retractable part 4 may be adaptively adjusted based on the appearance or contour of the product during practical assembly due to the flexibility of position and sufficiency of space during mounting the extendable and retractable part 4; the volume of lower-back supporting apparatus may be effectively reduced by adopting the extendable and retractable part 4; the whole of the extendable and retractable part 4 is easy to maintain and replace.

Specifically, each of the supporting structures comprises a first link 2 and a second link 3 hinged to each other, wherein the first link 2 of one of the supporting structures is hinged to the lower-back supporting plate 1 and the second link 3 thereof is hinged to the lower mounting plate 5; the second link 3 of another one of the support structures is hinged to the lower-back supporting plate 1, and the first link 2 thereof is hinged to the lower mounting plate 5; and two restricting protrusions 221 are provided on the first link 2, wherein the second link 3 and a hinge point between the first link 2 and the second link 3 are located between the two restricting protrusions 221. The structural design by cooperating the first link 2 with the second link 3 enables a wide range of a lifting height for the lower-back supporting apparatus, which may meet the demand of a broad range of the user.

Figure 2:
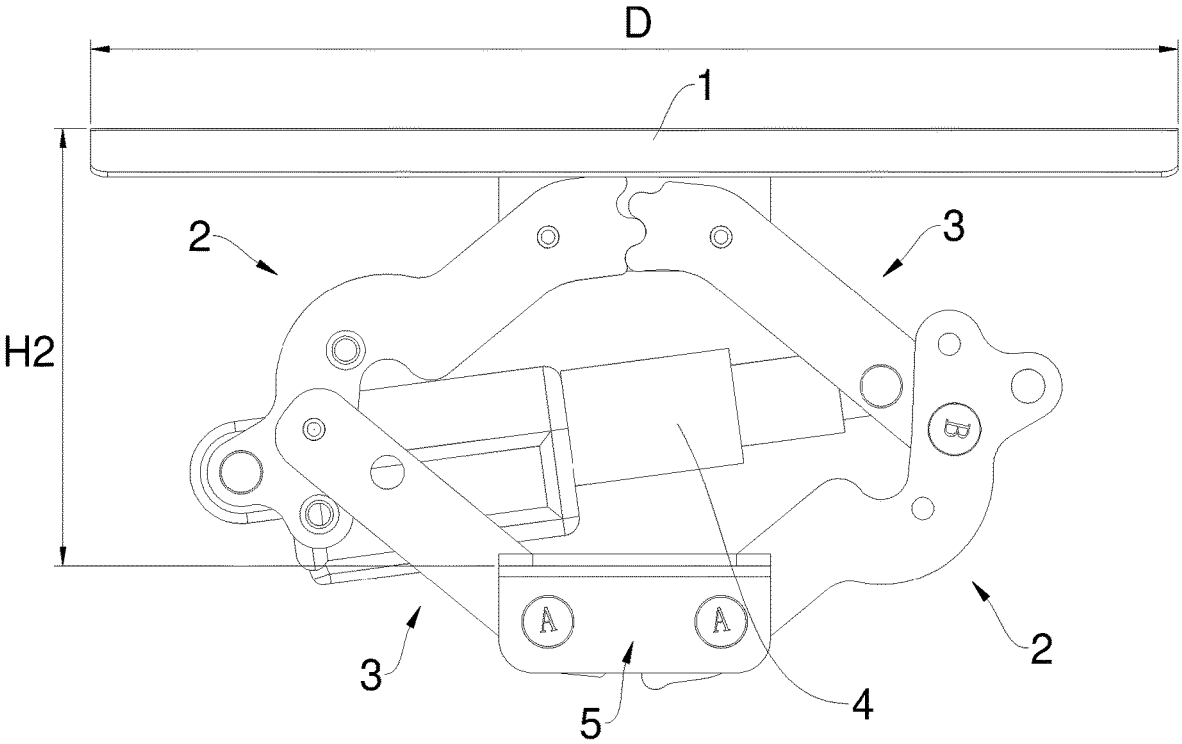
FIG. 2 is a front view of a structural diagram of a lower-back supporting apparatus provided in the present invention in the extended state.
Figure 3:
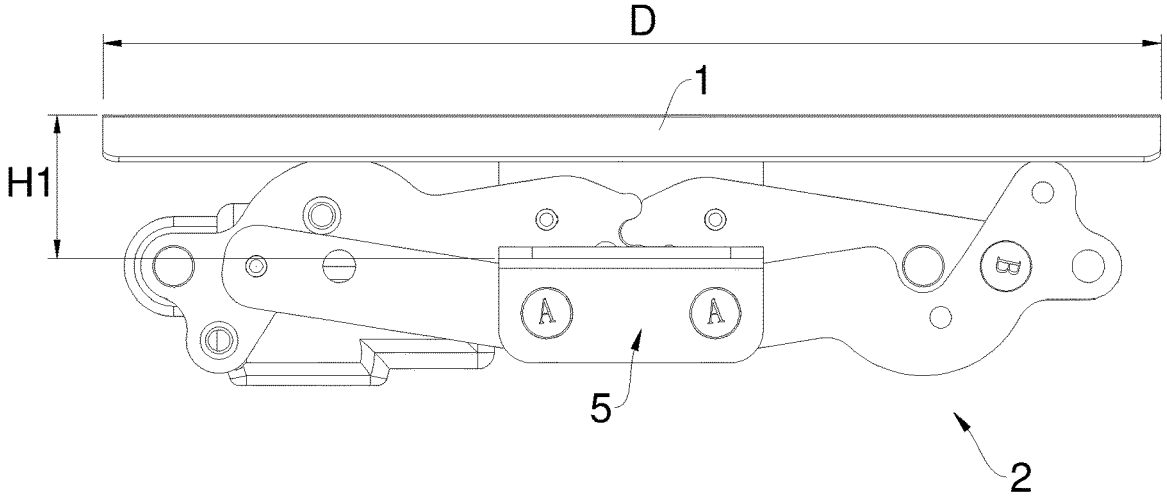
FIG. 3 is a front view of a structural diagram of a lower-back supporting apparatus provided in the present invention in the stored state.
Figure 4:
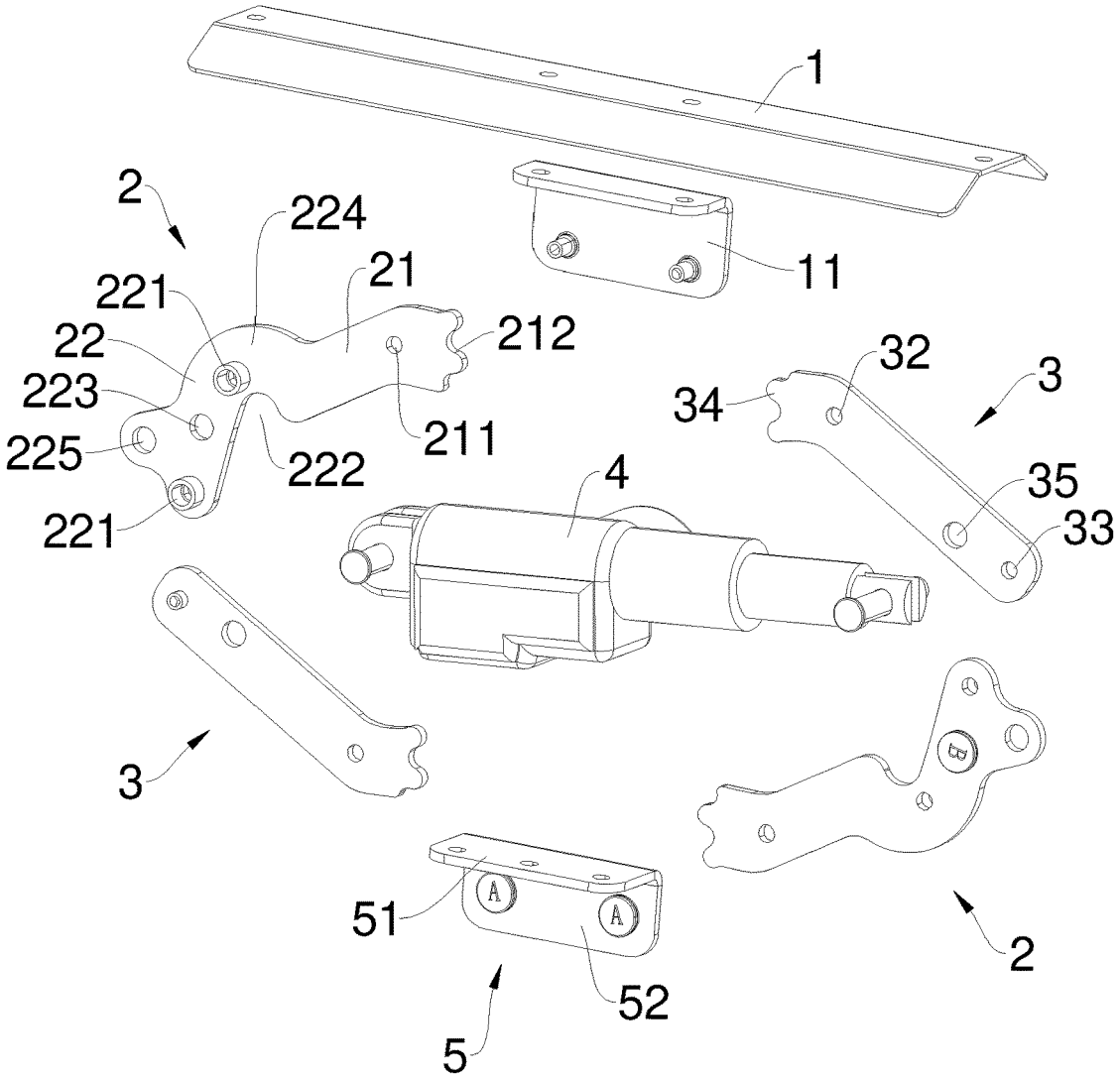
FIG. 4 is a first exploded view of a structural diagram of a lower-back supporting apparatus provided in the present invention.
Figure 5:
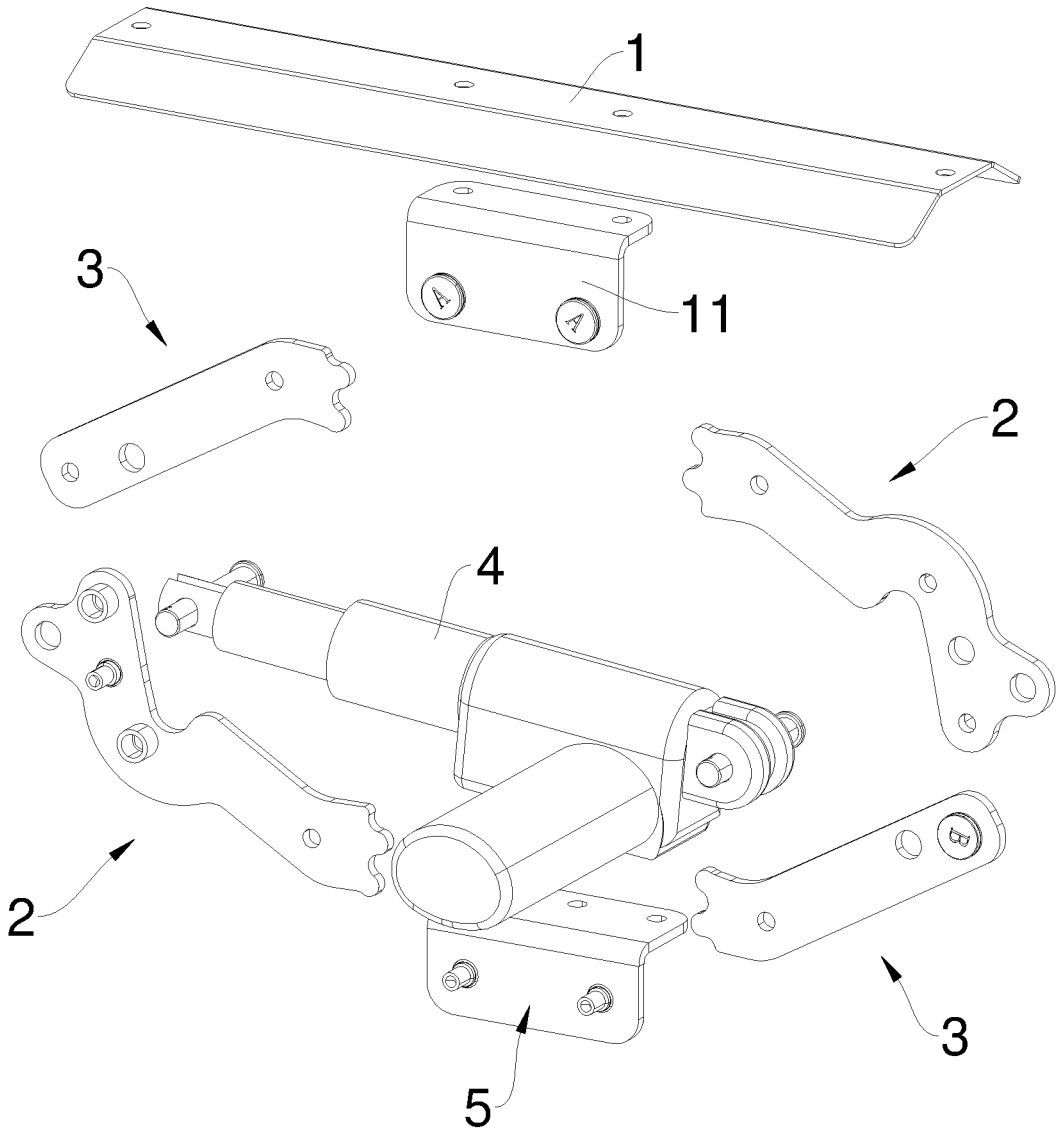
FIG. 5 is a second exploded view of a structural diagram of a lower-back supporting apparatus provided in the present invention.

As shown in FIG. 4 and FIG. 5, the first link 2 comprises a body part 21 and a restricting part 22 connected to each other; the hinge point between the first link 2 and the second link 3 is defined as the first hinge point 31, wherein the restricting protrusion 221 and the first hinge point 31 are both located on the restricting part 22; a convex arch 224 is provided on an outer side of the first link 2, and a concave arch 222 is provided on an opposite side of the convex arch 224, wherein the convex arch 224 and the concave arch 222 are both located on the restricting part 22; and at least one of the restricting protrusions 221 is provided on the convex arch 224. In the present embodiment, the body part 21 and the restricting part 22 are formed integrally; a more rational layout of the two restricting protrusions 221 provided on the restricting part 22 may be realized by providing the convex arch 224, that is, the lower-back supporting apparatus may realize the ultimate positions as shown in FIG. 2 and FIG. 3, which brings the lower-back supporting plate 1 as close as possible to the lower mounting plate 5 when the lower-back supporting apparatus is in the stored state, thereby leading to a more compact lower-back supporting apparatus in the stored state. In contrast, in the extended state, the lower-back supporting plate 1 is as far as possible from the lower mounting plate 5. In other words, the layout of the restricting protrusion 221 may increase the movement path of the lower-back supporting plate 1 relative to the lower mounting plate 5 by providing the convex arch 224.

In the present embodiment, a first hinged hole 223 is provided on the restricting part 22, and a fifth hinged hole 33 is provided on the second link 3; when the first link 2 is hinged to the second link 3, the first hinged hole 223 and the fifth hinged hole 33 share the same axis; the first hinged hole 223 and the fifth hinged hole 33 are fixed by a pin passing through both of them, with a first hinge point 31 locating on the central axis of the pin. Further, respective ends of the first link 2 and the second link 3 hinged to the lower-back supporting plate 1 near the lower-back supporting plate 1 are frictionally abutted. Specifically, a first tooth 212 and a second tooth 34 are correspondingly provided on the first link 2 and the second link 3; the first link 2 and the second link 3, hinged to the upper mounting plate 11, are engaged by the first tooth 212 and the second tooth 34; correspondingly, the first link 2 and the second link 3, hinged to the lower mounting plate 5, are also engaged by the first tooth 212 and the second tooth 34.

Figure 8:
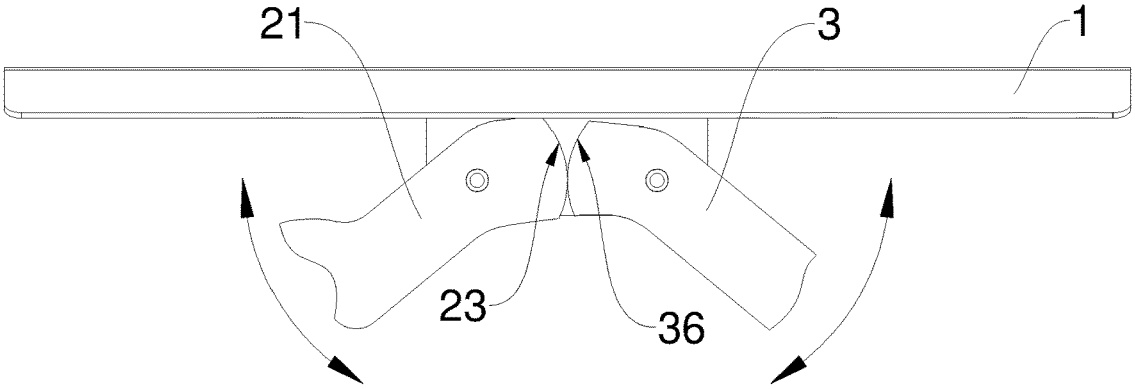
FIG. 8 is a diagram of the assembling structure of the first link and the second link of another lower-back supporting apparatus provided in the present invention.

As shown in FIG. 8, in other embodiments, a first frictional plane 23 and a second frictional plane 36 are correspondingly provided on the first link 2 and the second link 3; the first frictional plane 23 and the second frictional plane 36 are two rounded arc surfaces that abut each other. In use, the first frictional plane 23 and the second frictional plane 36 are always in linear contact when the first link 2 and the second link 3 rotate around the upper mounting plate 11 and the lower mounting plate 5. In order to further increase the friction between the first frictional plane 23 and the second frictional plane 36, elastic rubber gaskets may be provided on both working surfaces respectively, so that the two parts press and deform each other after assembly and they always maintain surface contact, so as to effectively prevent a relative sliding between the first frictional plane 23 and the second frictional plane 36 from leading to distortion of the lower-back supporting plate, thereby increasing the structural stability of the lower-back supporting plate when it is switched between the stored state and the extended state.

In the present embodiment, the extendable and retractable part 4 is provided between any two of the lower-back supporting plate 1, the lower mounting plate 5, the first link 2, and the second link 3, so as to drive the lower-back supporting plate 1 away or close to the lower mounting plate 5; or the extendable and retractable part 4 is provided between two first links 2 or two second links 3, so as to drive the lower-back supporting plate 1 away or close to the lower mounting plate 5. As shown in FIG. 1, preferably, a fixed end of the extendable and retractable part 4 is hinged to the first link 2 on the left side by a pin; an extendable and retractable end of the extendable and retractable part 4 is hinged to the second link 3 on the right side by a pin. Specifically, a second hinged hole 225 is provided on the restricting part 22 of the first link 2; a sixth hinged hole 35 is provided on the second link 3; the fixed end of the extendable and retractable part 4 is hinged to the second hinged hole 225 by a pin; the extendable and retractable end of the extendable and retractable part 4 is hinged to the sixth hinged hole 35 by a pin. In the other embodiment, the fixed end of the extendable and retractable part 4 may be provided on one of the first links 2, and the extendable and retractable end of the extendable and retractable part 4 may be provided on the other one of the first links 2; or the fixed end of the extendable and retractable part 4 may be provided on the one of the second link 3, the extendable and retractable end of the extendable and retractable part 4 may be provided on the other one of the second link 3.

In the present embodiment, a third hinged hole 211 is provided on the body part 21 of the first link 2; the first link 2 is respectively hinged to the upper mounting plate 11 and the lower mounting plate 5 through the third hinged hole 211 by pins. Correspondingly, a fourth hinged hole 32 is provided on the second link 3; the second link 3 is hinged to the upper mounting plate 11 and the lower mounting plate 5 through the fourth hinged hole 32 by pins. As shown in FIG. 4, the sixth hinged hole is located between the fourth hinged hole 32 and the fifth hinged hole 33; the sixth hinged hole 35 is provided near the fifth hinged hole 33 (the first hinge point 31), so as to facilitate the extendable and retractable part 4 to impose forces on the supporting structure (more effort saving when the extendable and retractable part 4 drives the supporting structure to move).

In the present embodiment, a concave arch 222 is provided on an opposite side of the convex arch 224, wherein the concave arch 222 is located on the restricting part 22. In the present embodiment, the concave arch 222 is used to accommodate the pin for mounting the extendable and retractable end of the extendable and retractable part 4 when the supporting structure is moving. In such a setup, specifically shown in FIG. 3, a more compact lower-back supporting apparatus in the stored state may be achieved. The structural design of the convex arch 224 and the concave arch 222 provided oppositely optimizes the structure of the first link 2 by realizing the respective structural purpose of the convex arch 224 and the concave arch 222 and ensuring the strength of the first link 2.

In the present embodiment, the extendable and retractable part 4 is any one of a cylinder, a hydraulic cylinder, or an electric pusher. Preferably, the extendable and retractable part 4 is an electric pusher.

As shown in FIG. 2, FIG. 3, and FIG. 4, a distance between the lower-back supporting plate 1 and the lower mounting plate 5 is defined as H; the H is between 55 and 250 millimeters when the lower-back supporting plate 1 is away or close to the lower mounting plate 5. In the present embodiment, the lower mounting plate 5 is L-shaped, and comprises a first fixing part 51 and a second fixing part 52 connected to each other, wherein the first link 2 and the second link 3 are connected to the second fixing part 52 when assembled on the lower mounting plate 5; the distance H between the lower-back supporting plate 1 and the lower mounting plate 5 is the distance between the upper surface of the lower-back supporting plate 1 and the lower surface of the lower mounting plate 5.

Specifically, as shown in FIG. 3, when the lower-back supporting apparatus is in a stored state, that is, when the lifting height of the lower-back supporting plate is in the lowest ultimate position, the distance H between the lower-back supporting plate 1 and the lower mounting plate 5 equals to H1, wherein H1 is between 55 and 150 millimeters. Preferably, H1 is 80 millimeters. H1 may be 85, 90, or 95 millimeters in the other embodiments.

As shown in FIG. 2, when the lower-back supporting apparatus is in the extended state, that is, when the lifting height of the lower-back supporting plate is in the highest ultimate position, the distance H between the lower-back supporting plate 1 and the lower mounting plate 5 equals to H2, wherein H2 is between 125 and 250 millimeters. Preferably, H2 is 220 millimeters. H2 may be 215, 225, or 230 millimeters in the other embodiments.

In the present embodiment, an extending direction of the lower-back supporting plate 1 is defined as a width direction; the lower-back supporting apparatus along the width direction is D, wherein D is between 180 and 440 millimeters. Preferably, D is 310 millimeters. D may be 340, 360, or 380 millimeters in the other embodiments. In the present embodiment, the overall width of the lower-back supporting apparatus is relatively narrow, while the adjustable lifting height of the lower-back supporting plate 1 is relatively sufficient when lifting, which may realize a wide range adjustment of the lower-back supporting plate 1 without occupying too much mounting space.

Figure 6:
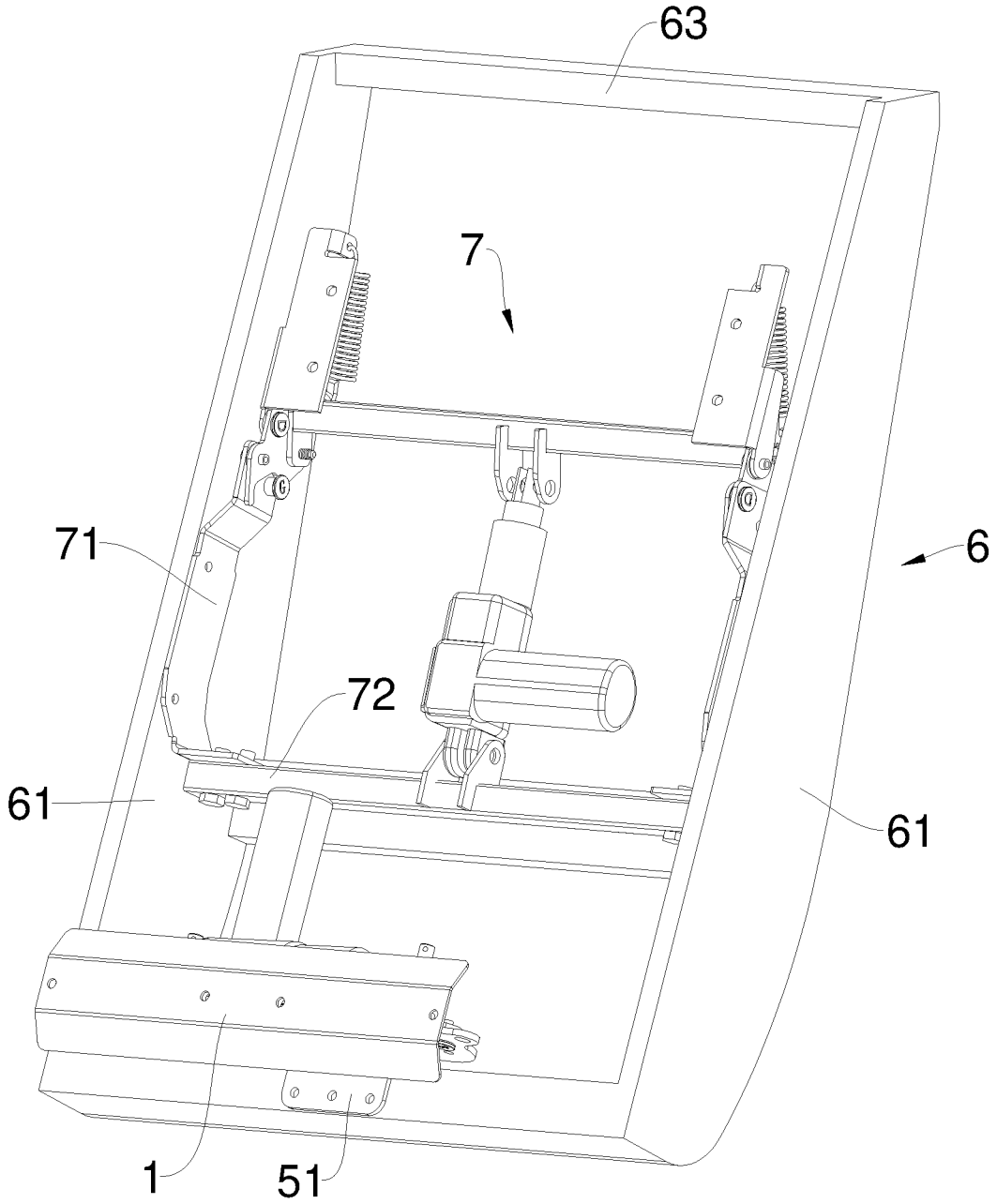
FIG. 6 is a first perspective view of a structural diagram of a backrest supporting frame provided in the present invention.
Figure 7:
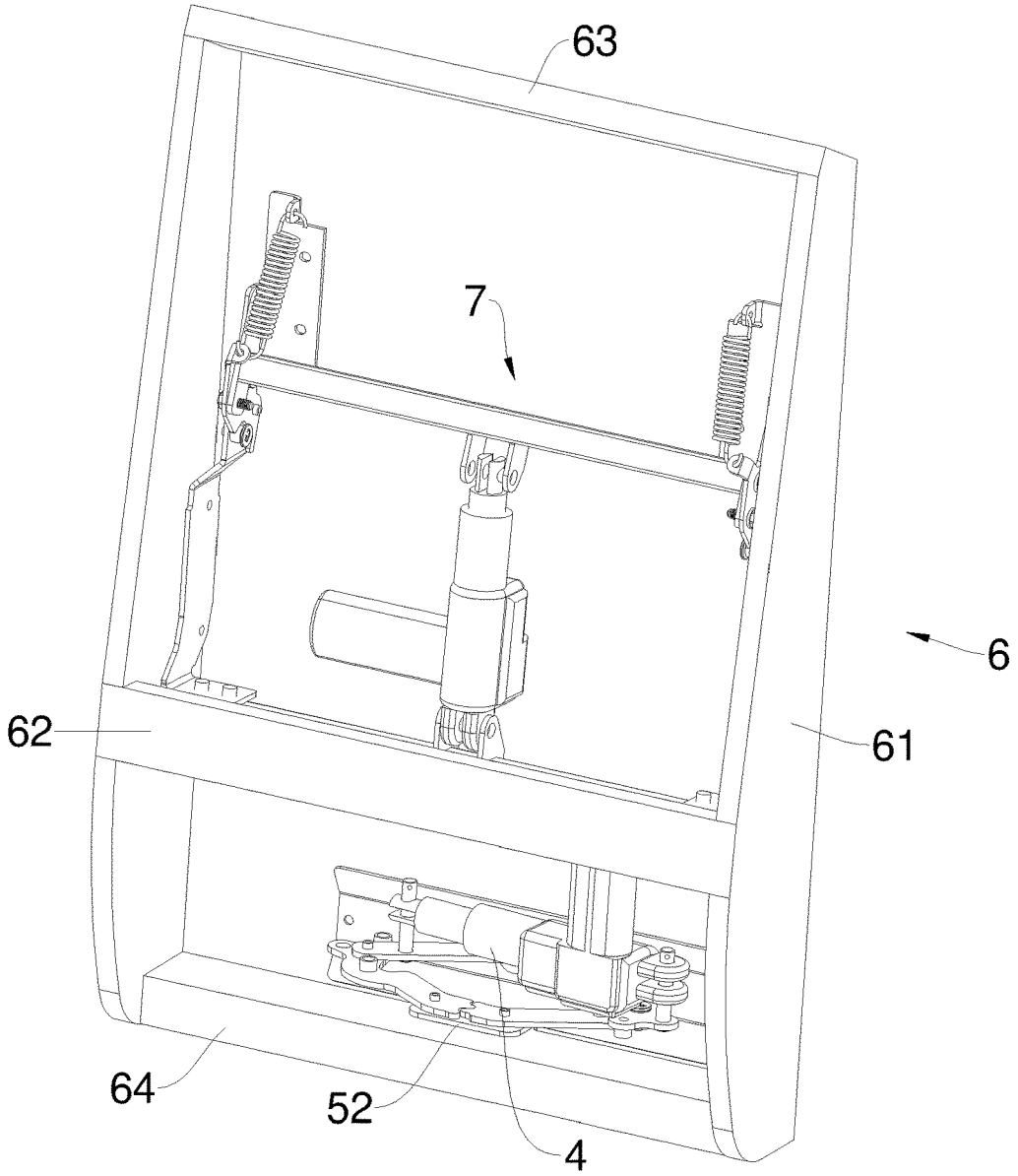
FIG. 7 is a second perspective view of a structural diagram of a backrest supporting frame provided in the present invention.

As shown in FIG. 6 and FIG. 7, further provided in the present embodiment is a backrest supporting frame comprising a fixing frame 6 and the lower-back supporting apparatus mentioned above, wherein the fixing frame 6 comprises two lateral plates 61 provided parallel; the lower-back supporting apparatus is fixedly mounted between two lateral plates 61. Further, a first crossbeam 63, a second crossbeam 62, and a third crossbeam 64 are respectively provided between two lateral plates 61, wherein the first crossbeam 63 is arranged close to an upper side of the lateral plate 61, the third crossbeam 64 is arranged close to a lower side of the lateral plate 61, and the second crossbeam 62 is arranged between the first crossbeam 63 and the third crossbeam 64. In the present embodiment, the lower-back supporting apparatus is fixedly mounted on the third crossbeam 64. The first crossbeam 63, the second crossbeam 62, and the third crossbeam 64 increase the structural stability of the fixing frame 6. After mounting, a lower surface of the first fixing part 51 abuts the third crossbeam 64, and they are fixedly connected by bolts or screws.

Figure 9:
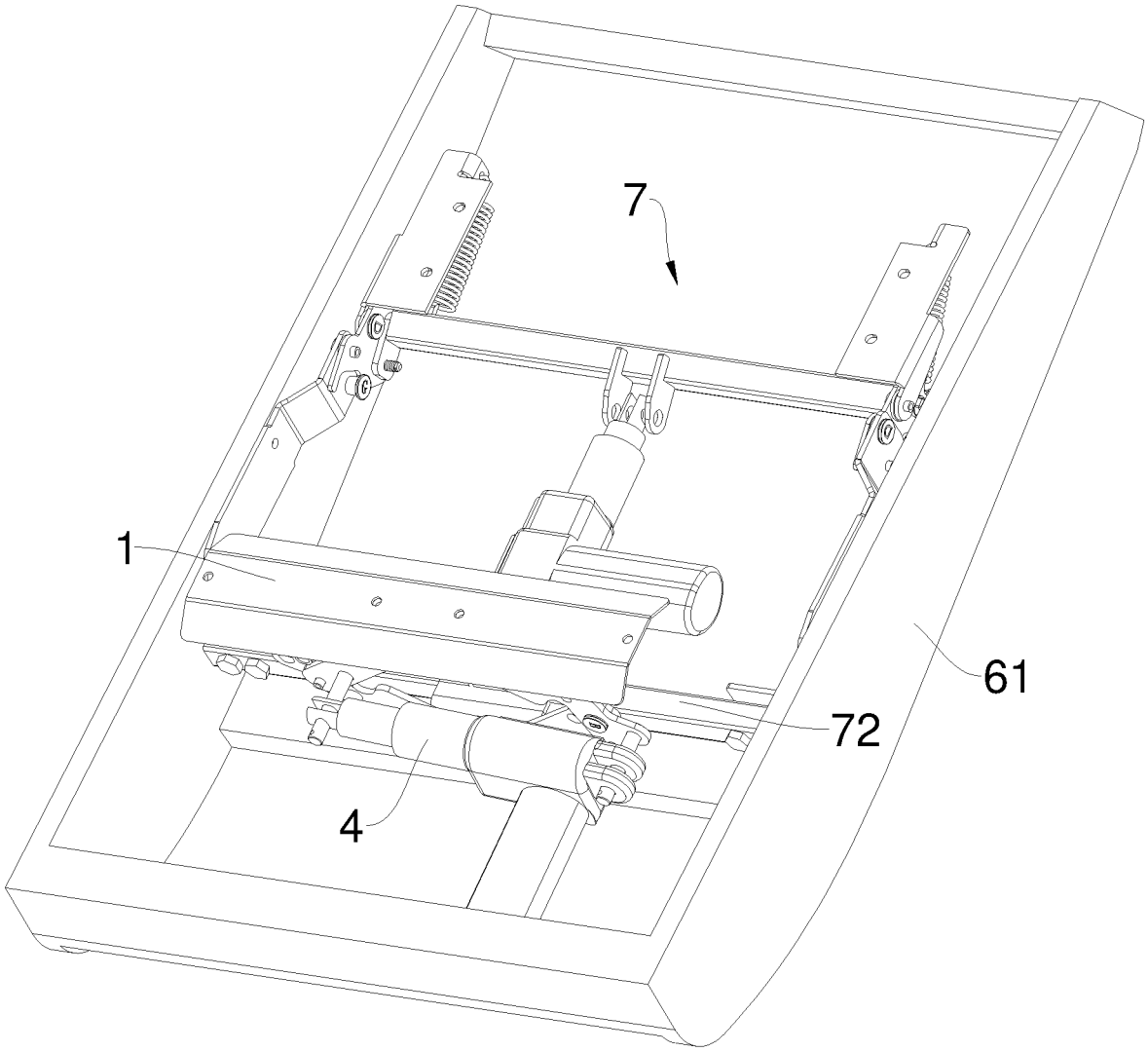
FIG. 9 is a second perspective view of a structural diagram of another backrest supporting frame provided in the present invention.

In addition, the backrest supporting frame further comprises a headrest structure 7, provided between two lateral plates 61 and located on an upper side of the lower-back supporting apparatus. The headrest structure 7 is referenced from the headrest assembly, fixing part 71, and transverse mounting link 72 disclosed in Chinese patent No. CN215533019U, i.e., the headrest structure 7 in the present embodiment, is a combination of the headrest assembly, fixing part 71, and transverse mounting link 72 in Chinese patent No. CN215533019U, which is prior art and will not be repeated hereby. It is to be noted that the fixing part 71 is fixedly mounted on the lateral plate 61 by screws or bolts. As shown in FIG. 9, the lower-back supporting apparatus in the other embodiment may connect to the headrest structure 7 integrally. Specifically, the first fixing part 51 is mounted on the transverse mounting link 72 by screws or bolts.

Provided in the present embodiment is a seating unit comprising the backrest supporting frame mentioned above, which may ease the fatigue of the user's back and facilitate maintenance.

Second Embodiment

The present embodiment is an improvement of the first embodiment, in which the same content will not be repeated herein.

In the present embodiment, the supporting structure comprises a first link 2 and a second link 3 hinged to each other, wherein the first link 2 is hinged to the lower-back supporting plate 1 and the second link 3 is hinged to the lower mounting plate 5; or, the second link 3 is hinged to the lower-back supporting plate 1 and the first link 2 is hinged to the lower mounting plate 5; and two restricting protrusions 221 are provided on the first link 2, wherein the second link 3 and a hinge point between the first link 2 and the second link 3 are located between the two restricting protrusions 221. In the present embodiment, the first link 2 and the second link 3 are identical in shape. The first link 2 and the second link 3 may, as well, not be limited in shape in any way, as it is sufficient that they may enable the lower-back supporting plate 1 to move up and down after they cooperate with each other.

Further, ends of the two first links 2 hinged to the lower-back supporting plate 1 near the lower-back supporting plate 1 are frictionally abutted, and ends of the two second links 3 hinged to the lower mounting plate 5 near the lower mounting plate 5 are frictionally abutted; or ends of the two second links 3 hinged to the lower-back supporting plate 1 near the lower-back supporting plate 1 are frictionally abutted, and ends of the two first links 2 hinged to the lower mounting plate 5 near the lower mounting plate 5 are frictionally abutted. The frictionally abutted structures and principles are the same as in the First Embodiment and will not be repeated hereby. It is to be noted that, in the present embodiment, two first links 2 or two second links 3 are simultaneously hinged to the upper mounting plate 11 or the lower mounting plate 5; thus, two first links 2 are engaged with each other through first teeth 212 and two second links 3 are engaged with each other through second teeth 34.

The technical means disclosed in the present inventive solution are not limited to those disclosed in the embodiments mentioned above but also include technical solutions consisting of any combination of the above technical features. It should be noted that for those of ordinary skill in the art, a plurality of improvements and embellishments may be made without departing from the principles of the present invention, and these improvements and modifications are also considered to be within the scope of protection of the present invention.

The invention claimed is:

1. A lower-back supporting apparatus, comprising:

a lower-back supporting plate (1);

a lower mounting plate (5);

two supporting structures, provided between the lower-back supporting plate (1) and the lower mounting plate (5), hinged to the lower-back supporting plate (1) and the lower mounting plate (5) respectively; and an extendable and retractable part (4), comprising an extendable and retractable end hinged to the lower-back supporting plate (1) or the supporting structures, so as to drive the lower-back supporting plate (1) away or close to the lower mounting plate (5), wherein each of the supporting structures comprises a first link (2) and a second link (3) hinged to each other, two restricting protrusions (221) are provided on the first link (2), wherein the second link (3) and a hinge point between the first link (2) and the second link (3) are located between the two restricting protrusions (221); and one of the following conditions (a), (b), or (c) is met:

(a) both first links (2) of the two supporting structures are hinged to the lower-back supporting plate (1), and both second links (3) of the two supporting structures are hinged to the lower mounting plate (5); or (b) both second links (3) of the two supporting structures are hinged to the lower-back supporting plate (1), and both first links (2) of the two supporting structures are hinged to the lower mounting plate (5); or (c) the first link (2) of one of the supporting structures is hinged to the lower-back supporting plate (1), the second link (3) thereof is hinged to the lower mounting plate (5), the second link (3) of another one of the support structures is hinged to the lower-back supporting plate (1), and the first link (2) thereof is hinged to the lower mounting plate (5).

2. The lower-back supporting apparatus according to claim 1, wherein the extendable and retractable part (4) is provided between any two of the lower-back supporting plate (1), the lower mounting plate (5), the first link (2), and the second link (3), so as to drive the lower-back supporting plate (1) away or close to the lower mounting plate (5); or the extendable and retractable part (4) is provided between two first links (2) or two second links (3), so as to drive the lower-back supporting plate (1) away or close to the lower mounting plate (5).

3. The lower-back supporting apparatus according to claim 2, wherein the extendable and retractable part (4) is any one of a cylinder, a hydraulic cylinder, or an electric pusher.

4. The lower-back supporting apparatus according to claim 1, wherein the first link (2) comprises a body part (21) and a restricting part (22) connected to each other;

the hinge point between the first link (2) and the second link (3) is defined as the first hinge point (31), wherein the restricting protrusion (221) and the first hinge point (31) are both located on the restricting part (22);

a convex arch (224) is provided on an outer side of the first link (2), and a concave arch (222) is provided on an opposite side of the convex arch (224), wherein the convex arch (224) and the concave arch (222) are both located on the restricting part (22); and at least one of the restricting protrusions (221) is provided on the convex arch (224).

5. The lower-back supporting apparatus according to claim 1, when the condition (a) or (b) is met:

wherein ends of the two first links (2) hinged to the lower-back supporting plate (1) near the lower-back supporting plate (1) are frictionally abutted, and ends of the two second links (3) hinged to the lower mounting plate (5) near the lower mounting plate (5) are frictionally abutted; or ends of the two second links (3) hinged to the lower-back supporting plate (1) near the lower-back supporting plate (1) are frictionally abutted, and ends of the two first links (2) hinged to the lower mounting plate (5) near the lower mounting plate (5) are frictionally abutted.

6. The lower-back supporting apparatus according to claim 5, wherein a distance between the lower-back supporting plate (1) and the lower mounting plate (5) is defined as H; the H is between 55 and 250 millimeters when the lower-back supporting plate (1) is away or close to the lower mounting plate (5).

7. The lower-back supporting apparatus according to claim 1, when the condition (c) is met:

wherein respective ends of the first link (2) and the second link (3) hinged to the lower-back supporting plate (1) near the lower-back supporting plate (1) are frictionally abutted; and respective ends of the first link (2) and the second link (3) hinged to the lower mounting plate (5) near the lower mounting plate (5) are frictionally abutted.

8. The lower-back supporting apparatus according to claim 7, wherein a distance between the lower-back supporting plate (1) and the lower mounting plate (5) is defined as H; the H is between 55 and 250 millimeters when the lower-back supporting plate (1) is away or close to the lower mounting plate (5).

9. The lower-back supporting apparatus according to claim 1, wherein a distance between the lower-back supporting plate (1) and the lower mounting plate (5) is defined as H; the H is between 55 and 250 millimeters when the lower-back supporting plate (1) is away or close to the lower mounting plate (5).

10. The lower-back supporting apparatus according to claim 9, wherein an extending direction of the lower-back supporting plate (1) is defined as a width direction; the lower-back supporting apparatus along the width direction is between 180 and 440 millimeters.

11. A backrest supporting frame, comprising a fixing frame (6) and the lower-back supporting apparatus as claimed in claim 1, wherein:

the fixing frame (6) comprises two lateral plates (61) connected by a crossbeam; and the lower-back supporting apparatus is provided between the two lateral plates (61) and fixedly mounted on the crossbeam by the lower mounting plate (5).

12. The backrest supporting frame according to claim 11, further comprising a headrest structure (7) provided between the two lateral plates (61) and located on an upper side of the lower-back supporting apparatus.

13. A seating unit, comprising the backrest supporting frame as claimed in claim 11.

* * * * *